US012727649B1

(12) United States Patent
Murphy et al.

(10) Patent No.: US 12,727,649 B1
(45) **Date of Patent: *Sep. 8, 2026**

(54) CRASH LOCKING TONGUE

(71) Applicant: Autoliv ASP, Inc., Ogden, UT (US)

(72) Inventors: Dan Murphy, Auburn Hills, MI (US); Jon Burrow, Auburn Hills, MI (US)

(73) Assignee: AUTOLIV ASP, INC., Ogden, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/234,487

(22) Filed: Jun. 11, 2025

(51) Int. Cl.
*A44B 11/25* (2006.01)

(52) U.S. Cl.
CPC ..... *A44B 11/2561* (2013.01); *A44B 11/2569* (2013.01)

(58) Field of Classification Search
CPC ..... B60R 22/185; B60R 2022/1812
See application file for complete search history.

(56) References Cited

U.S. PATENT DOCUMENTS 5,222,278 A * 6/1993 Ball ..... A44B 11/2553 297/483
5,599,070 A * 2/1997 Pham ..... B60N 2/688 297/483
5,806,148 A * 9/1998 McFalls ..... A44B 11/2561 24/171
5,870,816 A * 2/1999 McFalls ..... B60R 22/30 29/434
10,518,740 B2 * 12/2019 Ruthinowski ..... A44B 11/2561
11,142,161 B2 10/2021 Clauss et al.
11,254,282 B2 * 2/2022 Garcia Stopier ... B60R 22/1855
2006/0138852 A1 * 6/2006 Ichida ..... A44B 11/2557 297/483
2007/0138783 A1 * 6/2007 Gleason ..... B60R 22/24 297/483
2012/0240358 A1 * 9/2012 Cox ..... A44B 11/2561 24/164
2017/0055643 A1 * 3/2017 Knoedl ..... A44B 11/2561
2017/0355349 A1 * 12/2017 Betz ..... B60R 22/1855
2019/0239598 A1 * 8/2019 Ver Hoven ..... A44B 11/2561
2020/0216014 A1 * 7/2020 Garcia Stopier ... B60R 22/1855
(Continued)

FOREIGN PATENT DOCUMENTS

CN 111491831 A * 8/2020 ..... A44B 11/2553
DE 202010013986 U1 * 3/2012 ..... A44B 11/2553
DE 102013003109 A1 * 8/2014 ..... B60R 22/00
(Continued)

*Primary Examiner* — Nicole T Verley
(74) *Attorney, Agent, or Firm* — Dickinson Wright PLLC

(57) ABSTRACT

A crash locking tongue for use as part of a seat belt restraining system that includes a buckle that is reversibly coupled with the crash locking tongue and a belt webbing that restrains the movement of a passenger in a vehicle. The crash locking tongue includes a base plate configured to reversibly couple with the buckle; a lockbar having a clamping surface that is in contact with the belt webbing; an elastomeric spring; and a cover material overmolded on the base plate. The crash locking tongue is configured such that the lockbar undergoes a vertical translation upon the occurrence of a vehicle accident. This vertical translation applies an inward pressure on the belt webbing, thereby, reducing or eliminating movement of the belt webbing.

13 Claims, 8 Drawing Sheets

(56) References Cited

U.S. PATENT DOCUMENTS

| | | | | |
|---|---|---|---|---|
| 2020/0298791 | A1 | 9/2020 | Clauss et al. | |
| 2021/0197760 | A1 * | 7/2021 | Nagasawa | B60R 22/023 |

FOREIGN PATENT DOCUMENTS

| | | | | | |
|---|---|---|---|---|---|
| DE | 102016106440 | A1 | * | 10/2017 | B60R 22/1855 |
| DE | 202019100137 | U1 | * | 4/2019 | B60R 22/18 |
| DE | 102016106440 | B4 | * | 5/2019 | B60R 22/18 |
| DE | 102014017788 | B4 | * | 3/2020 | B60R 22/1855 |
| DE | 102020201614 | A1 | | 8/2021 | |
| JP | 2010162921 | A | * | 7/2010 | |
| JP | 2013107422 | A | * | 6/2013 | |
| JP | 2014046721 | A | * | 3/2014 | |
| JP | 2014108762 | A | * | 6/2014 | |
| JP | 2014125022 | A | * | 7/2014 | |
| JP | 2015020580 | A | * | 2/2015 | |
| JP | 5943512 | B2 | * | 7/2016 | A44B 11/2561 |
| JP | 2018127107 | A | * | 8/2018 | A44B 11/2561 |
| JP | 2018135017 | A | * | 8/2018 | |
| TW | I640444 | B | * | 11/2018 | A44B 11/2557 |
| WO | WO-2006072314 | A1 | * | 7/2006 | B60R 22/185 |
| WO | WO-2006092206 | A1 | * | 9/2006 | B60R 22/1855 |
| WO | WO-2013099590 | A1 | * | 7/2013 | A44B 11/2553 |
| WO | WO-2014152152 | A1 | * | 9/2014 | B60R 21/18 |

* cited by examiner

CRASH LOCKING TONGUE

FIELD

This invention generally relates to a crash locking tongue that enhances the ability to restrain a passenger in a motor vehicle upon the occurrence of an accident or crash. This invention further relates to a seat belt restraining system that incorporates such a crash locking tongue, as well as a method of using the seat belt restraining system.

BACKGROUND

The statements in this section merely provide background information related to the present disclosure and may not constitute prior art.

A seat belt restraining system in a motor vehicle generally includes a belt webbing that can be freely pulled from a retractor and coupled via a tongue plate to a seat buckle secured to the body of the vehicle in order for a passenger to be physically restrained in a seat. In the event of a vehicle accident or crash, a locking mechanism is triggered in the retractor that prevents further pulling of the belt webbing. The use of a crash locking tongue further enhances the restraint of the passenger by locking the belt webbing in place upon the occurrence of the accident.

Although the benefits associated with using a crash locking tongue are recognized in the industry, conventional crash locking tongues also exhibit multiple disadvantages. For example, such conventional crash locking tongues are generally large in size, heavy in weight, and expensive to manufacture. Such conventional crash locking tongues also are limited in that they must be used with only specific types of belt webbing. Thus, there is considerable industrial interest in the development of a next generation crash locking tongue that is smaller, lighter, lower cost, and works with a wider range of webbing types.

SUMMARY

The present disclosure generally provides a crash locking tongue for use as part of a seat belt restraining system that includes a buckle that is reversibly coupled with the crash locking tongue and a belt webbing that restrains the movement of a passenger in a vehicle. The crash locking tongue generally comprises: a base plate configured to reversibly couple with the buckle; a lockbar having a clamping surface that is in contact with the belt webbing; an elastomeric spring; and a cover material overmolded on the base plate. The belt webbing loops around the lockbar when the crash locking tongue and the buckle are coupled.

The crash locking tongue is configured such that the lockbar undergoes a vertical translation upon the occurrence of a vehicle accident. The vertical translation of the lockbar applies an inward pressure on the belt webbing, thereby, reducing or eliminating further movement of the belt webbing. The inward pressure or force occurs between the overmolded cover material and the clamping surface of the lockbar. The belt webbing includes a torso side that faces the passenger with the vertical translation of the lockbar applying the pressure to this torso side. When desirable, the engagement between the lockbar and the belt webbing may be enhanced by the presence of one or more protrusions arising from the clamping surface of the lockbar.

The vertical translation of the lockbar compresses the elastomeric spring present in the crash locking tongue. When desirable to further enhance the engagement between the lockbar and the belt webbing, the lockbar and elastomeric spring may be configured to allow at least a portion of the compressed elastomeric spring to be forced through one or more openings in the lockbar, such that the elastomeric spring also makes contact the belt webbing.

The crash locking tongue may also comprise at least one overlap region between the lockbar and the overmolded cover material. These overlap region(s) are designed to assist in preventing disengagement of the lockbar and the overmolded cover material during use.

The crash locking tongue may also comprise at least one interlock region formed by features of the lockbar and the overmolded cover material. This interlock region is designed to assist in load distribution during use. The formation of this interlock region by the lockbar and the overmolded cover material stops the occurrence of any further compression of the elastomeric spring and/or vertical translation of the lockbar.

According to another aspect of the present disclosure, a seat belt restraining system is provided that comprises a buckle, a belt webbing to restrain the movement of a passenger in a vehicle, and a crash locking tongue as described above and as further defined herein.

According to yet another aspect of the present disclosure, a method for enhancing the restraint of a passenger in a vehicle by a seat belt restraining system upon an occurrence of an accident is provided. This method generally comprises the steps of: providing a seat belt restraining system comprising a belt webbing, a buckle, and a crash locking tongue as described above and as further defined herein; restraining the passenger in the vehicle by coupling the crash locking tongue to the buckle; wherein the belt webbing loops around the lockbar in the crash locking tongue; and allowing the lockbar to translate vertically upon the occurrence of the accident. The lockbar compresses the elastomeric spring and applies a force against the webbing between the clamping surface of the lockbar and one or more of the overmolded cover material and the base plate. Since the force applied to the belt webbing clamps the belt webbing in place on a side of the belt webbing that faces the passenger, the clamping of the belt webbing provides a maximum webbing resistance as defined by the Capstan or belt friction equation.

Further areas of applicability will become apparent from the description provided herein. One skilled in the art will understand that the description and specific examples presented herein are intended for purposes of illustration only and are not intended to limit the scope of the present disclosure.

DRAWINGS

In order that the disclosure may be well understood, there will now be described various forms thereof, given by way of example, reference being made to the accompanying drawings.

Figure 1:
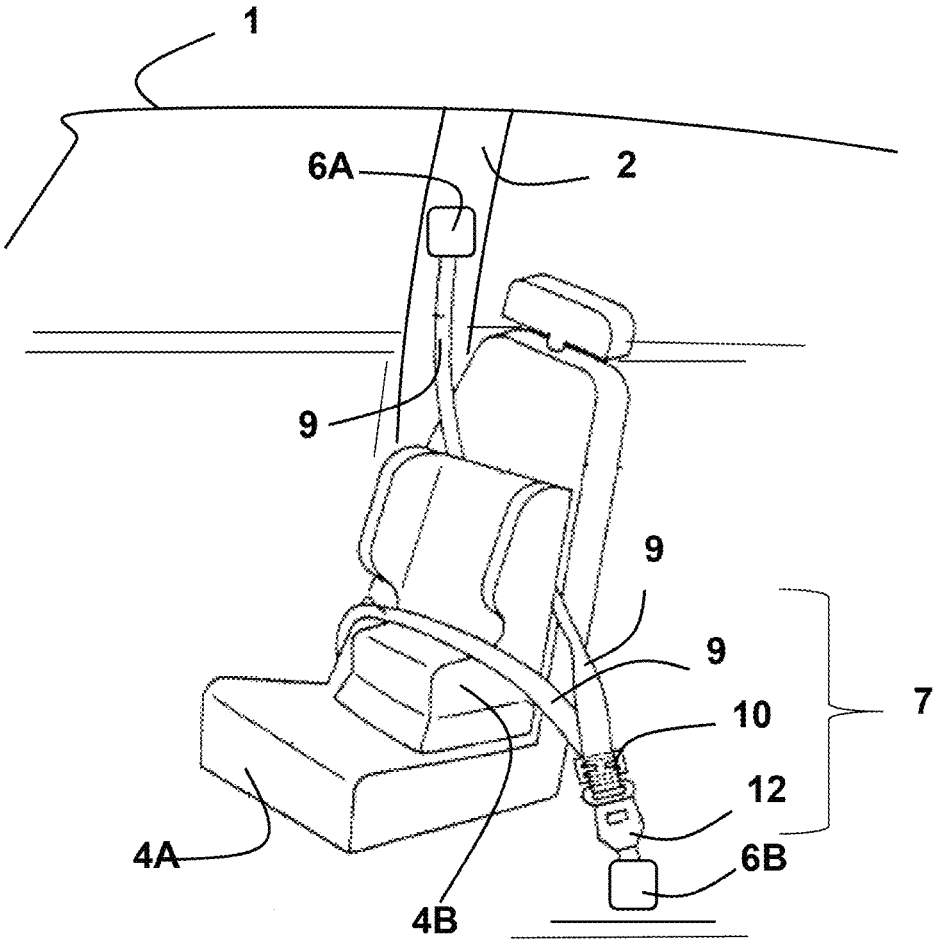
FIG. 1 is a schematic representation of a seat belt system in a motor vehicle that incorporates the crash locking tongue (CLT) formed according to the teachings of the present disclosure.

The drawings described herein are for illustration purposes only and are not intended to limit the scope of the present disclosure in any way.

DETAILED DESCRIPTION

The following description is merely exemplary in nature and is in no way intended to limit the present disclosure or its application or uses. For example, the crash locking tongue made and used according to the teachings contained herein is described throughout the present disclosure in conjunction with a seat belt restraining system in a motor vehicle (e.g., an automobile) in order to more fully illustrate the composition and the use thereof. The incorporation and use of such a tongue assembly in other vehicles, including off-road vehicles, trucks, boats, helicopters, and other aircraft or the like are contemplated to be within the scope of the present disclosure. One skilled in the art will understand that throughout the description, corresponding reference numerals indicate like or corresponding parts and features.

The present disclosure relates generally to a crash locking tongue for use in a motor vehicle seat belt system that includes a buckle, which is reversibly coupled with the crash locking tongue, and a belt webbing that restrains the movement of a passenger in a vehicle. Referring to FIG. 1 a seat belt restraining system 7 for a motor vehicle 1 is depicted. During the operation of the motor vehicle 1, a passenger (not shown) in the vehicle 1 will sit in a seat 4A or child seat 4B and be restrained by a length of belt webbing 9 that is anchored to the vehicle's body 2. More specifically, one portion of the belt webbing 9 is secured to an anchor point 6A. The opposite end of the belt webbing 9 is attached to a retractor (not shown), which is also secured to the vehicle's body. Intermediate to the ends of the belt webbing 9, the webbing 9 passes through a crash locking tongue assembly 10 that is part of the seatbelt restraining system 7. When the seat belt restraining system 7 is in use, the crash locking tongue assembly 10 latches with a seat buckle 12 that is also secured on its opposite end to the body of the vehicle at point 6B, thereby, restraining the torso of the passenger (not shown) against the seat 4*a*, 4*b*. When the seat belt restraining system 7 is not in use, the belt webbing is wound on the retractor with a portion of the webbing 9 becoming vertically oriented on one side of the seat 4A with the crash locking tongue assembly 10 hanging therefrom (i.e., not coupled to the buckle 12).

The crash locking tongue formed according to the present disclosure provides multiple advantages in the form of improved compatibility with the belt webbing, reduced mass, reduced manufacturing cost, and a reduced level of complexity. In addition, the clamping surface of the lockbar applies a force that works with the forces associated with the belt webbing rather than in opposition thereto. Thus, the use of the crash locking tongue maximizes the webbing resistance as determined according to the Capstan or belt friction equation (e.g., Euler-Eytelwein formula).

Referring now to FIGS. 2A to 2D, the crash locking tongue 10 generally comprises a base plate 15 configured to reversibly couple with a seat buckle 12, a lockbar 20 that has a clamping surface 25 that is in contact with the belt webbing 9, an elastomeric spring 30, and a cover material 35 overmolded on the base plate. The crash locking tongue 10 is configured such that the lockbar 20 undergoes a vertical translation (0) upon the occurrence of a vehicle accident. The vertical translation (1) of the lockbar 20 applies an inward pressure or force on the belt webbing 9, thereby, reducing or eliminating movement of the belt webbing 9.

Figures 2A, 2B, 2C:
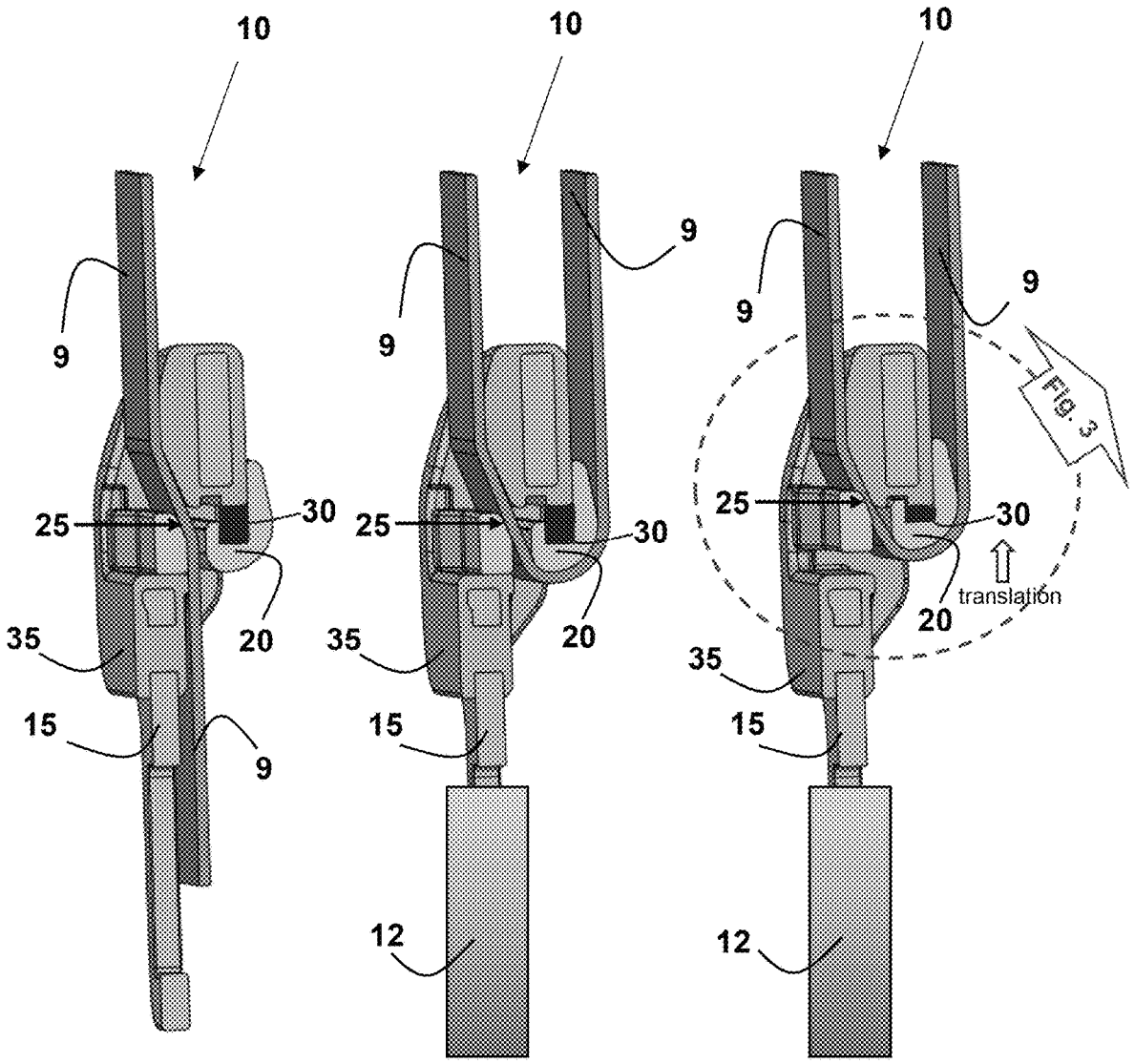
FIG. 2A is a cross-sectional view of a crash locking tongue according to the present disclosure shown in a free-state or unlocked position.
FIG. 2B is a cross-sectional view of the crash locking tongue of FIG. 2A shown in a locked or buckled position.
FIG. 2C is a cross-sectional view of the crash locking tongue of FIG. 2B shown in a post-lock position after the occurrence of a motor vehicle accident or crash.
Figure 2D:
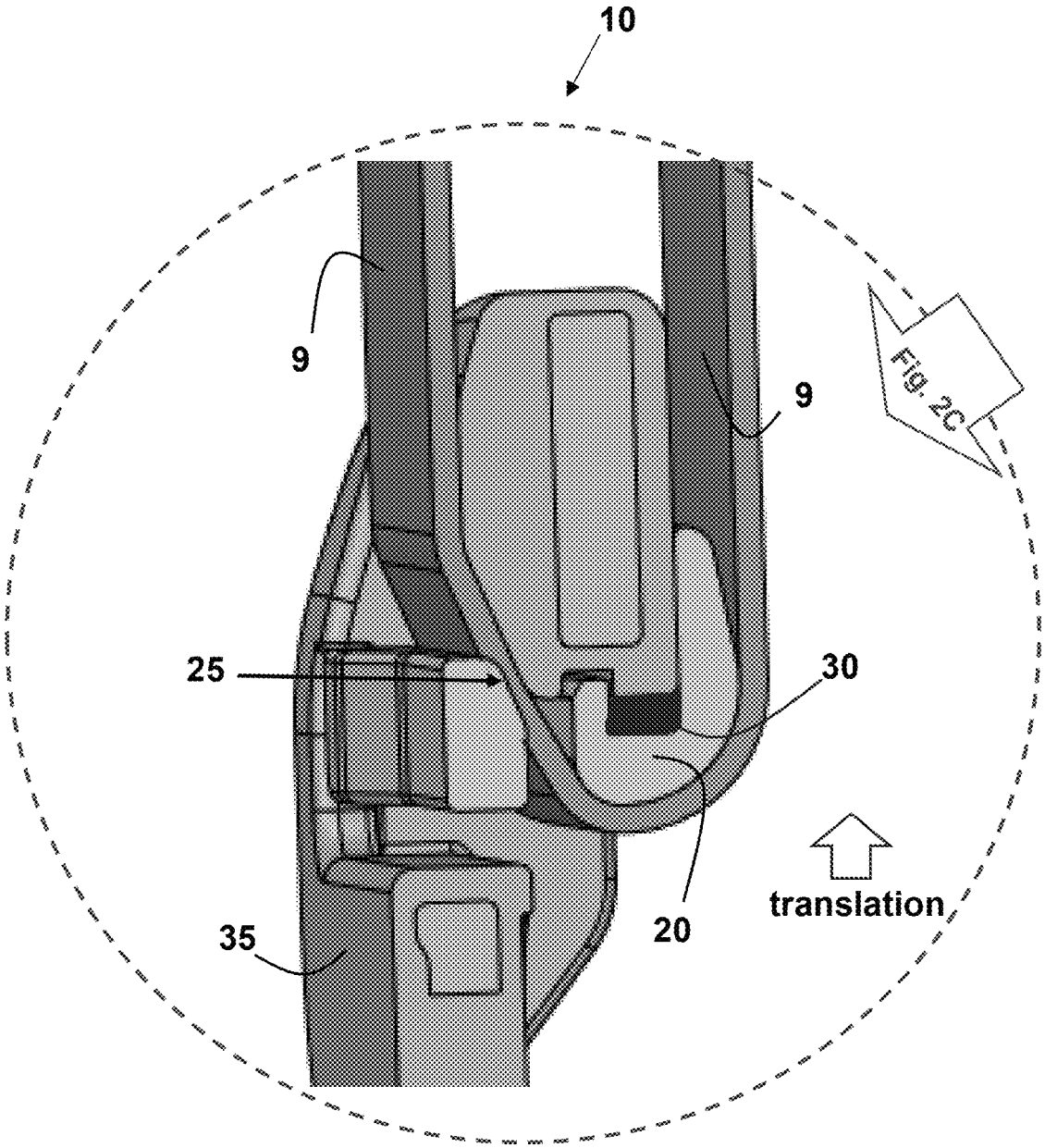
FIG. 2D is an enlarged cross-sectional view of a portion of the crash locking tongue of FIG. 2C.

In FIG. 2A, the crash locking tongue 10 is shown in a free-state condition, which means that it is not coupled to the seat buckle. In this case, the crash locking tongue 10 as stated above may interact with and hang from the belt webbing 9. In FIG. 2B, the crash locking tongue 10 is coupled to the seat buckle 12. In this buckled-state condition, the belt webbing 9 loops around the lockbar 20, thereby restraining the passenger in the seat. Upon the occurrence of a vehicle crash or accident as shown in FIG. 2C and the enlarged view provided in FIG. 2D, the lockbar 20 translates vertically, thereby, compressing the elastomeric spring 30. In other words, the lockbar 20 applies a force to the belt webbing 9, which further pinches the webbing 9 between the clamping surface 25 of the lockbar 20 and one or more of the overmolded cover material 35 and the base plate 15. Alternatively, the webbing 9 is pinched between the clamping surface 25 and the overmolded cover material 35. In this post-lock position, the movement of the webbing 9 is effectively reduced or eliminated and the passenger is further restrained in the seat of the vehicle.

The base plate 15 may comprise a metal, a metal alloy, or another high strength material formed as a single or solid piece. The base plate 15 is used to latch or reversibly couple with the buckle 12 in the seat belt restraining system 7. The metal or metal alloy may include, but not be limited to a AISI 4130 alloy steel that incorporates one or more strengthening agents, such as chromium or molybdenum, to name a few. When desirable, the base plate 15 may be heat treated to harden the metal or metal alloy and/or plated (e.g., chrome plating, etc.) to further enhance properties, including without limitation, aesthetic qualities, the strength, or corrosion resistance of the base plate 15.

The cover material 35 may be placed in contact with the surface of the base plate 15 through the use of a molding process, such as a compression molding process or injection molding process. The composition of the overmolded cover material 35 generally is not restricted. Alternatively, the composition of the overmolded cover material 35 may comprise one or more types of moldable thermoplastic polymers. For example, these thermoplastic polymer(s) may include, but not be limited to, one or more of a polytetrafluoroethylene, a polyphenylene, a polystyrene, a polyamide, an acrylic, a phenolic, a polyacetal, a polybutadiene, a polyethylene-polybutadiene, a polyetherimide, and a mixture or copolymer thereof. Alternatively, the cover material may comprise one or more polyamides, such as, without limitation, NYLON® 6, NYLON® 11, or NYLON® 12. When desirable the overmolded cover material 35 may further include one or more additives (colorants, dispersants, biocides, flame retardants, etc.) in order to enhance manufacturability and/or performance.

The lockbar 20 may be made of the same or similar material as the overmolded cover material 35. Alternatively, the lockbar 20 and the overmolded cover material 35 are different materials. Since the lockbar 20 does not need to displace the belt webbing 9, a lockbar 20 having a lower stiffness may be utilized when desired. However, the material utilized in the lockbar 20 may be selected to enhance the ability to clamp the belt webbing (i.e., increase coefficient of friction) and/or be resistant to the occurrence of wear upon contact between the lockbar 20 and the belt webbing 9. Additional information regarding the design, assembly, and operation of the lockbar within the confines of the crash locking tongue may be found in a co-pending application entitled "Lockbar for a Crash Locking Tongue and a Method of Assembly Thereof" filed simultaneously with the present disclosure, the entire content of which is hereby incorporated by reference.

The composition of the elastomeric spring 30 generally is not restricted in that it may comprise any elastomeric or rubber material. Alternatively, this elastomeric or rubber material may comprise any moldable thermoplastic or thermoset polymers, including but not limited to, one or more of a silicone, a natural butyl rubber (NBR), a polychoroprene rubber, a styrene-butadiene rubber (SBR), an ethylene propylene diene monomer (EPDM) rubber, a chlorosulfonated polyethylene (CSPE), a polypropylene, and a mixture or copolymer thereof.

Figures 3, 4A, 4B:
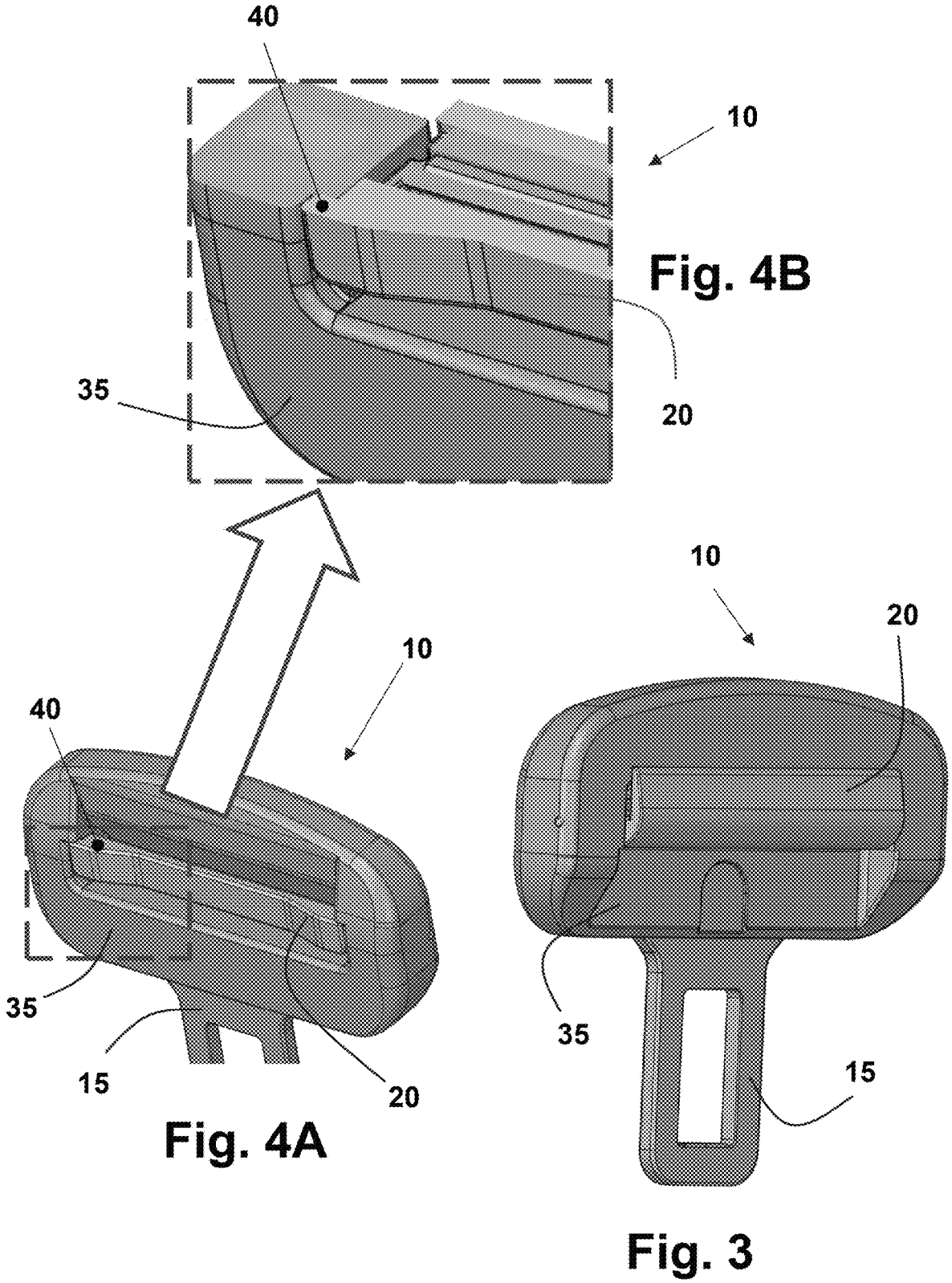
FIG. 3 is a perspective view of the front side of a crash locking tongue according to the teachings of the present disclosure.
FIG. 4A is a perspective view of the back-side of the crash locking tongue of FIG. 3.
FIG. 4B is an enlarged top-down cross-sectional view of a portion of the crash locking tongue of FIG. 4A.

Referring now to FIG. 3 and FIGS. 4A to 4B, perspective views of both the front and back of the crash locking tongue 10 are shown. When desirable, as shown in FIGS. 4A & 4B, one or more edges of the lockbar 20 and the overmolded cover material 35 may comprise an overlap region 40. This overlap region 40 prevents the lockbar 20 and the cover material 35 from becoming disengaged when the seat belt restraining system is in use.

Figures 5A, 5B:
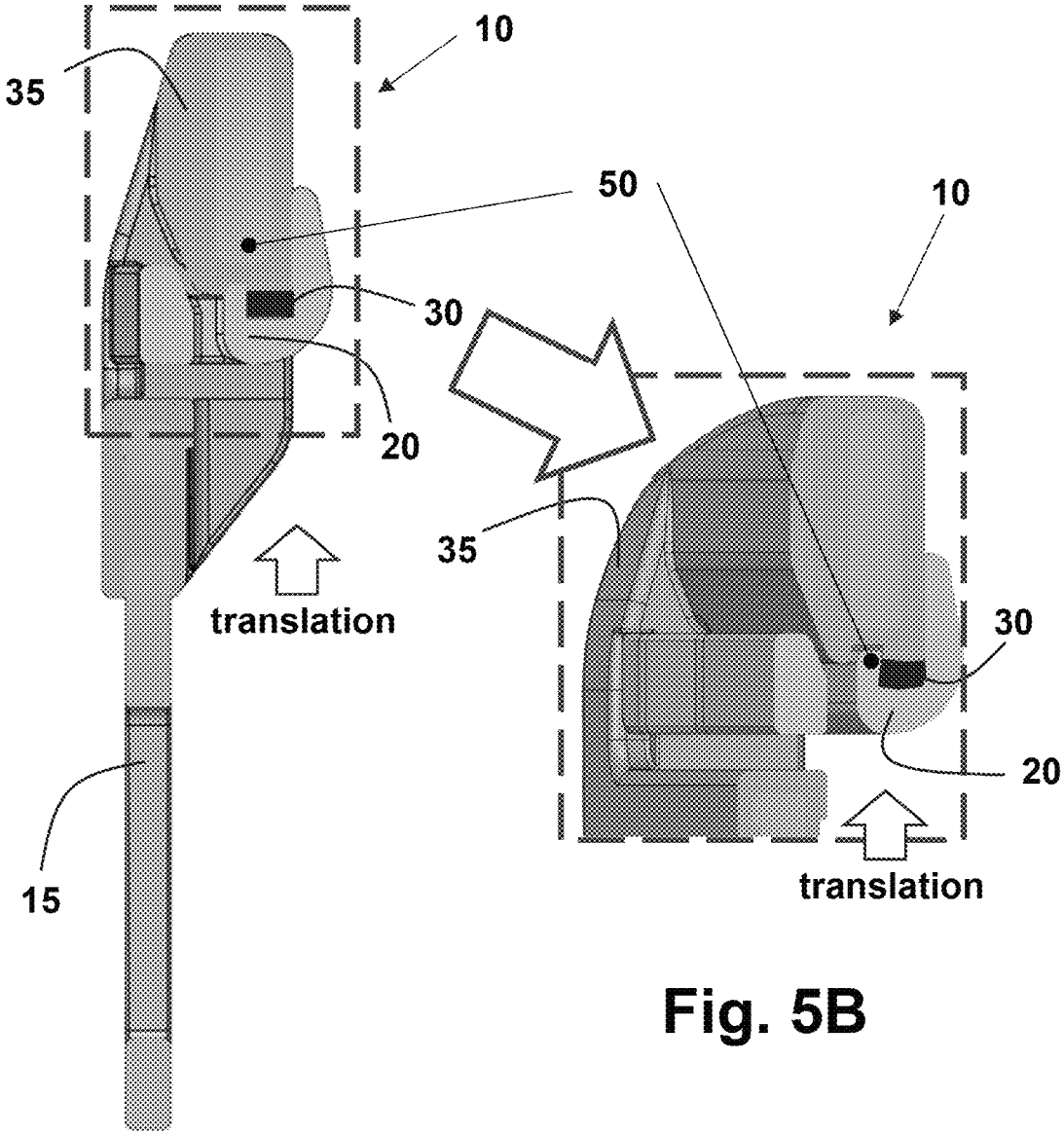
FIG. 5A is another cross-sectional view of the crash locking tongue of FIG. 2C shown in a post-lock position after the occurrence of a motor vehicle accident or crash.
FIG. 5B is an enlarged cross-sectional view of a portion of the crash locking tongue of FIG. 5A.

Referring now to FIGS. 5A & 5B, the overmolded cover material 35 and the lockbar 20 are also shown to form an interlock region 50. As the elastomeric spring 30 is compressed by the vertical translation (↑) of the lockbar 20 upon the occurrence of a vehicle crash or accident, a portion of the lockbar 20 travels into an indentation in the overmolded cover material 35 thereby forming the interlock region 50. The creation of such an interlock region 50 stops the lockbar 20 from any further vertical translation and/or compression of the elastomeric spring 30. The formation of this interlock region 50 effectively assists in load distribution within the seat belt restraining system.

Figure 6A:
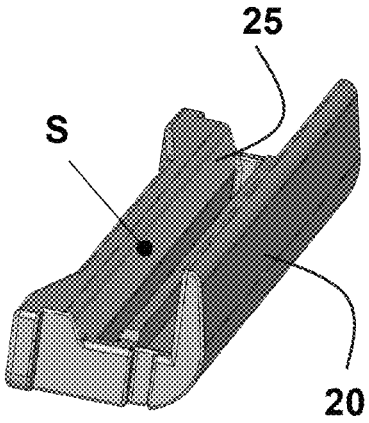
FIG. 6A is a perspective view of the lockbar in a crash locking tongue that highlights characteristics of the clamping surface located therein according to one aspect of the present disclosure.
Figure 6B:
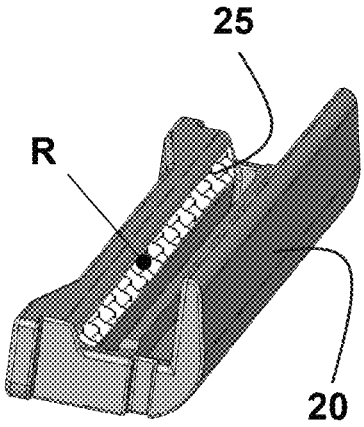
FIG. 6B is another perspective view of the lockbar in a crash locking tongue that describes another clamping surface according to the teachings of the present disclosure.
Figure 6C:
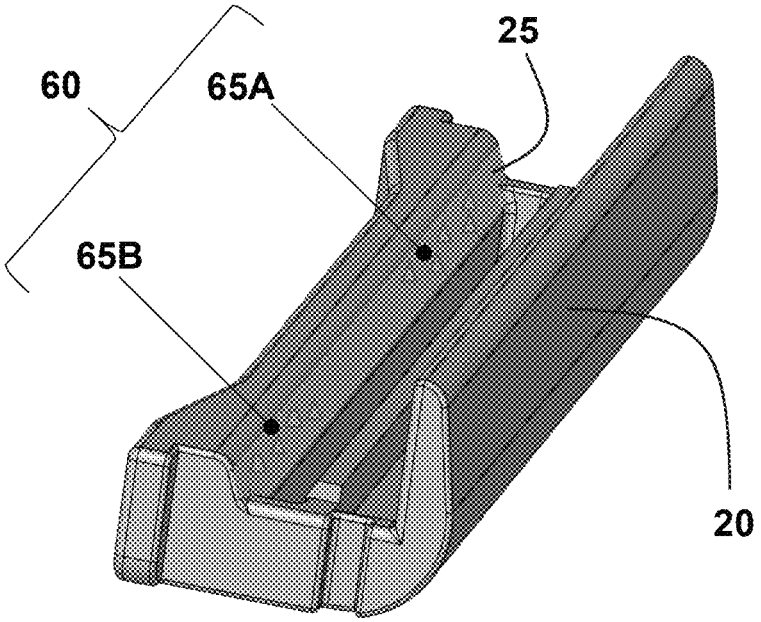
FIG. 6C is yet another perspective view of a lockbar in a crash locking tongue that describes another clamping surface according to the teachings of the present disclosure.

The geometry of the clamping surface 25 of the lockbar 20 may comprise a smooth surface S or a rough surface R as depicted in FIGS. 6A and 6B. According to another aspect of the present disclosure, the clamping surface 25 may be designed with one or more protruding features 60 in order to increase the engagement that occurs between the lockbar 20 and individual fibers in the belt webbing 9. The shape of these protruding features 60 is not restricted in that they may any feasible shape that would increase the interaction between the clamping surface 25 of the lockbar 20 and the belt webbing 9. Each of the protruding features 60 may have the same or similar shape 60A; alternatively, the protruding features may comprise more than one shape 60B.

Figure 7:
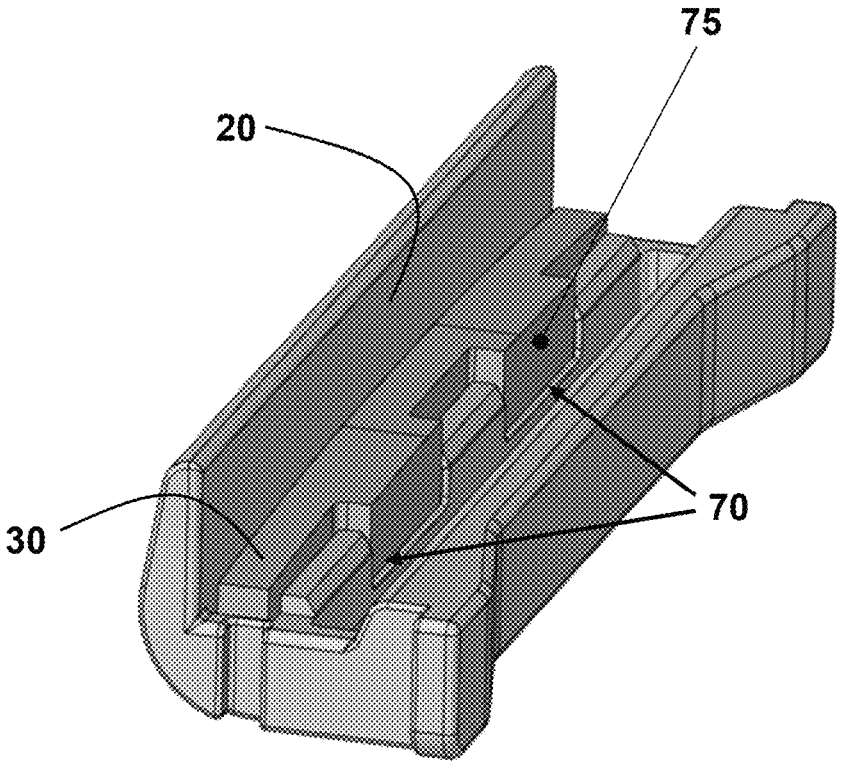
FIG. 7 is another perspective view of the lockbar in a crash locking tongue that highlights an interaction with an elastomer according to another aspect of the present disclosure.

Referring now to FIG. 7, the lockbar 20 and the elastomeric spring 30 may be configured, such that the lockbar 20 comprises one or more openings 70. When the elastomeric spring 30 is compressed, the elastomeric spring 30 may elongate and/or be pushed through these openings 70, which provides an additional surface 75 that can engage with the belt webbing in order to increase the clamping effect or locking load. In this case, the elastomeric spring 30 may assist or aid in providing the clamping force against the belt webbing.

According to another aspect of the present disclosure, when the lockbar translates vertically, it clamps or applies a force to the belt webbing on the side of the webbing that faces the restrained passenger. The application of force by the lockbar in this direction maximizes the webbing resistance as determined according to the Capstan or belt friction equation (e.g., Euler-Eytelwein formula) as described in Equation 1 below.

$$T_2 = T_1 * e^{(\mu * \theta)} \qquad \text{Eq. 1}$$

In the Capstan equation, $T_2$ represents the tension on the side of belt webbing where the force is being applied, $T_1$ represents the tension on the side of the belt webbing where the force is being resisted, $\mu$ is the coefficient of static friction between the belt webbing and the clamping surface of the lockbar, and $\theta$ is the wrap angle (in radians) for the belt webbing around the restrained passenger. The Capstan equation generally indicates that the tension on the side where the force is being applied exponentially increases when the wrap angle and/or the coefficient of friction is increased.

Figure 8:
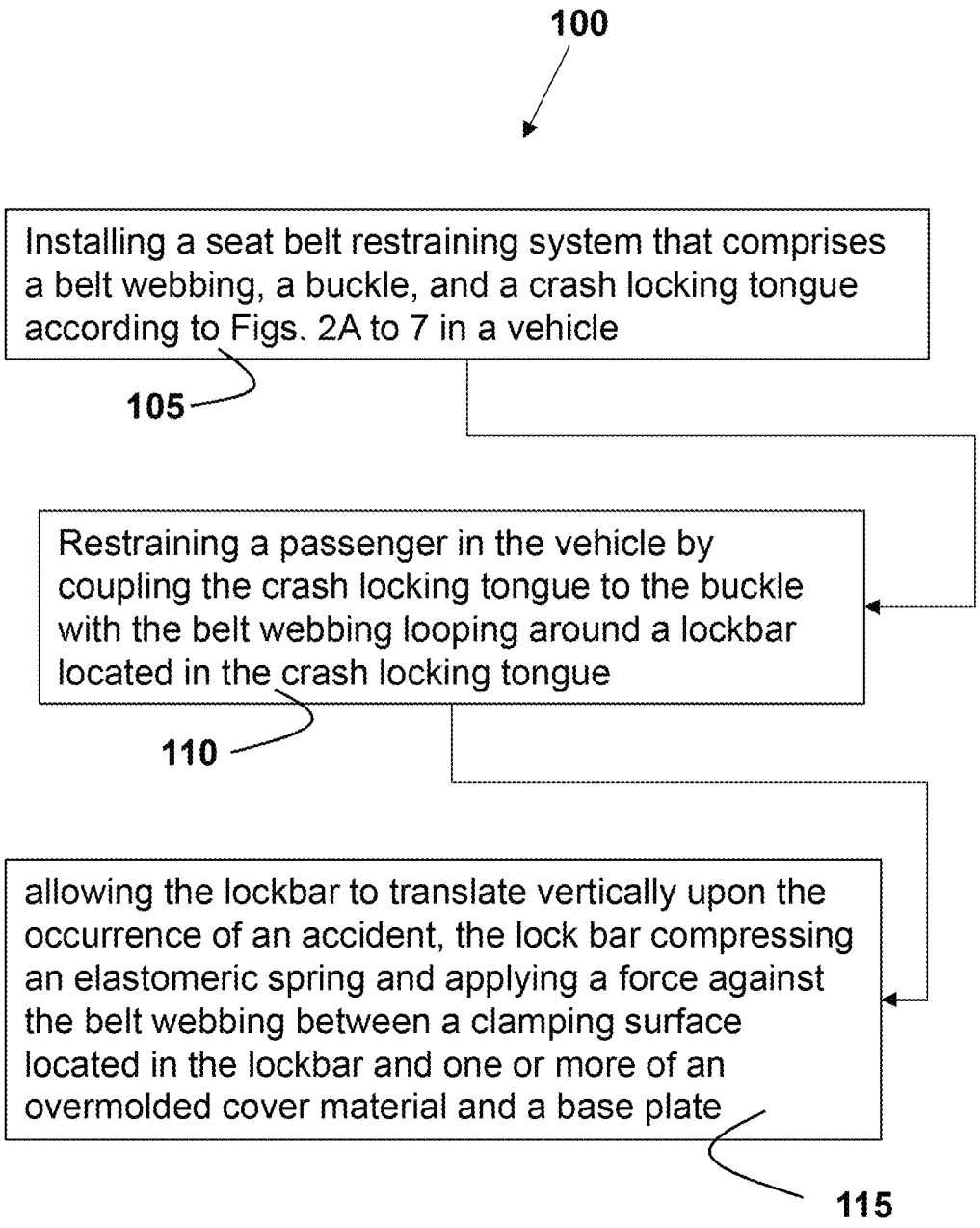
FIG. 8 is a flowchart of a method for enhancing the restraint of a passenger in a vehicle by a seat belt restraining system upon the occurrence of an accident according to another aspect of the present disclosure.

According to another aspect of the present disclosure, a method for enhancing the restraint of a passenger in a vehicle by a seat belt restraining system upon the occurrence of an accident is provided. Referring now to FIG. 8, this method 100 generally comprises the following steps. First, a seat belt restraining system that comprises a belt webbing, a buckle, and a crash locking tongue as previously described above and further defined herein is installed 105 in a vehicle. Then a passenger is restrained 110 in the vehicle by coupling the crash locking tongue to the buckle with the belt webbing looping around a lockbar located in the crash locking tongue. Finally, the lockbar is allowed 115 to translate vertically upon the occurrence of an accident. Upon this vertical movement, the lockbar compresses an elastomeric spring and applies a force against the belt webbing between a clamping surface located in the lockbar and an overmolded cover material and/or base plate, thereby further restraining the passenger. Alternatively, the webbing is pinched between the clamping surface and the overmolded cover material.

For the purpose of this disclosure, the terms "about" and "substantially" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one opening", "one or more openings", and "opening(s)" may be used interchangeably and are intended to have the same meaning.

Within this specification, embodiments have been described in a way which enables a clear and concise specification to be written, but it is intended and will be appreciated that embodiments may be variously combined or separated without departing from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A crash locking tongue for use as part of a seat belt restraining system that includes a buckle that is reversibly coupled with the crash locking tongue and a belt webbing that restrains the movement of a passenger in a vehicle, the crash locking tongue comprising:

a base plate configured to reversibly couple with the buckle;

a lockbar having a clamping surface that is in contact with the belt webbing;

an elastomeric spring; and a cover material overmolded on the base plate;

wherein the crash locking tongue is configured such that the lockbar undergoes a vertical translation upon the occurrence of a vehicle accident, the vertical translation applies an inward pressure on the belt webbing, thereby, reducing or eliminating movement of the belt webbing;

wherein the vertical translation of the lockbar compresses the elastomeric spring with at least a portion of the compressed elastomeric spring being forced through one or more openings in the lockbar thereby enhancing engagement between the lockbar and the belt webbing.

2. The crash locking tongue according to claim 1, wherein the belt webbing loops around the lockbar when the crash locking tongue and the buckle are coupled.

3. The crash locking tongue according to claim 1, wherein the inward pressure occurs between the clamping surface of the lockbar and one or more of the overmolded cover material and the base plate.

4. The crash locking tongue according to claim 1, wherein the crash locking tongue further comprises at least one overlap region between the lockbar and the overmolded cover material in order to prevent disengagement.

5. The crash locking tongue according to claim 1, wherein the crash locking tongue further comprises at least one interlock region formed by features of the lockbar and the overmolded cover material in order to assist in load distribution.

6. The crash locking tongue according to claim 1, wherein the clamping surface comprises one or more protrusions that enhances engagement between the lockbar and individual fibers in the belt webbing.

7. The crash locking tongue according to claim 5, wherein the formation of the interlock region by the lockbar and the overmolded cover material stops any further compression of the elastomeric spring.

8. The crash locking tongue according to claim 1, wherein the belt webbing includes a torso side that faces the passenger and the vertical translation of the lockbar applies the pressure to the torso side.

9. The use of the crash locking tongue according to claim 1 as part of a seat belt restraining system that incorporates a belt webbing to restrain the movement of a passenger in a vehicle.

10. A seat belt restraining system comprising a buckle, a belt webbing to restrain the movement of a passenger in a vehicle and a crash locking tongue according to claim 1.

11. A method for enhancing the restraint of a passenger in a vehicle upon an occurrence of an accident, the method comprising the steps of:

installing a seat belt restraining system that comprises a belt webbing, a buckle, and a crash locking tongue according to claim 1 in the vehicle;

restraining the passenger in the vehicle by coupling the crash locking tongue to the buckle; wherein the belt webbing loops around the lockbar in the crash locking tongue; and allowing the lockbar to translate vertically upon the occurrence of the accident, the lockbar compressing the elastomeric spring and applying a force against the webbing between the clamping surface of the lockbar and one or more of the overmolded cover material and the base plate, thereby, further restraining the passenger; and forcing at least a portion of the compressed elastomeric spring through the one or more openings in the lockbar thereby enhancing engagement between the lockbar and the belt webbing.

12. The method according to claim 11, wherein the force applied to the belt webbing clamps the belt webbing in place on a side of the belt webbing that faces the passenger.

13. The method according to claim 12, wherein the clamping of the belt webbing provides a maximum webbing resistance as defined by a Capstan or belt friction equation.

* * * * *